US005290036A

United States Patent [19]

Fenton et al.

[11] Patent Number: 5,290,036

[45] Date of Patent: Mar. 1, 1994

[54] CAVITY BACK IRON WITH VIBRATION DAMPENING MATERIAL IN REAR CAVITY

[76] Inventors: Frank Fenton, 14 Magnolia Ter., South Hadley, Mass. 01075; Michael J. Sullivan, 58 Marlborough St., Chicopee, Mass. 01020

[21] Appl. No.: 45,358

[22] Filed: Apr. 12, 1993

[51] Int. Cl.[5] ..... A63B 53/04

[52] U.S. Cl. ..... 273/167 R; 273/167 H; 273/DIG. 8

[58] Field of Search ..... 273/77 R, 167 R, 167 A, 273/167 B, 167 C, 167 E, 167 F, 167 G, 168, 169, 170, 171, 172, 173, 174, 175, 193 R, 194 R, DIG. 23, DIG. 8, 73 F

[56] References Cited

U.S. PATENT DOCUMENTS

| | | | |
|---|---|---|---|
| 3,937,474 | 2/1976 | Jepson et al. | 273/DIG. 8 X |
| 4,326,716 | 4/1982 | Lacoste | 273/167 R |
| 4,462,589 | 7/1984 | Morgan | 273/DIG. 8 X |
| 4,582,321 | 4/1986 | Yoneyama | 273/173 X |
| 4,624,460 | 11/1986 | Murase et al. | 273/DIG. 8 X |
| 4,653,756 | 3/1987 | Sato | 273/169 X |
| 4,740,345 | 4/1988 | Nagasaki et al. | 273/167 H X |
| 4,936,582 | 6/1990 | Bernstein | 273/DIG. 8 X |
| 4,964,640 | 10/1990 | Nakanishi | 273/167 A |
| 5,178,392 | 1/1993 | Santioni | 273/167 H |
| 5,244,211 | 9/1993 | Lukasiewicz | 273/167 R |

*Primary Examiner*—Vincent Millin
*Assistant Examiner*—Sebastiano Passaniti
*Attorney, Agent, or Firm*—Donald R. Bahr; John E. Benoit

[57] ABSTRACT

A cavity back iron with vibration dampening material in the cavity. The material is a polyurethane having a hardness of 20-50 Shore D, a flexural modulus of 1,000-50,000 p.s.i., a percent elongation of 100-600, and a tensile strength of 2,000-8,000 p.s.i.

9 Claims, 1 Drawing Sheet

CAVITY BACK IRON WITH VIBRATION DAMPENING MATERIAL IN REAR CAVITY

This invention relates generally to golf club irons and more specifically to cavity back irons and a means for dampening the inherent vibration in such irons.

Normal cavity back irons have a thin-faced section resulting from the use of the cavity. Since no material normally is used in these cavities, the harsh feel of striking the ball is quite apparent while using clubs having such cavities.

It has been proposed to build a cavity back iron with a thin face which then requires a reinforcement member of material such a fiber-reinforced plastic. The primary purpose of this type of construction is to actually reinforce the club rather than attempting to reduce any vibrations. In one such known club, as described in U.S. Pat. No. 4,928,972 issued May 29, 1990, it is proposed that the cavity include a fiber reinforcement adjacent the interface of the cavity and that an epoxy resin be used as a backup. While such an arrangement may somewhat reduce the shock experienced when striking a ball, epoxy resins tend to be brittle; and if they are formulated so as to provide a softer material, they suffer from relatively poor abrasion resistance and significantly low toughness. This is very important for golf club application, where golf club heads rattle against each other in the golf bag so that the back cavity filler can be abraded, scratched, and damaged significantly.

Accordingly, it is an object of the present invention to use a vibration dampening material in a cavity back iron which can provide a material having the necessary softness and elasticity to create a substantial lessening of vibration while still having a toughness to prevent abrasion from scratching with resultant damage to the clubs.

A further object of the present invention is to provide a polyurethane which substantially fills the rear cavity of the cavity back iron.

SUMMARY OF THE INVENTION

A cavity back iron is provided with vibration dampening material in the cavity. The material is a polyurethane having a hardness of 20–50 Shore D, a flexural modulus of 1,000–50,000 p.s.i., a percent elongation of 100–600, and a tensile strength of 2,000–8,000 p.s.i.

DETAILED DESCRIPTION OF THE PREFERRED EMBODIMENTS

Figure 1:
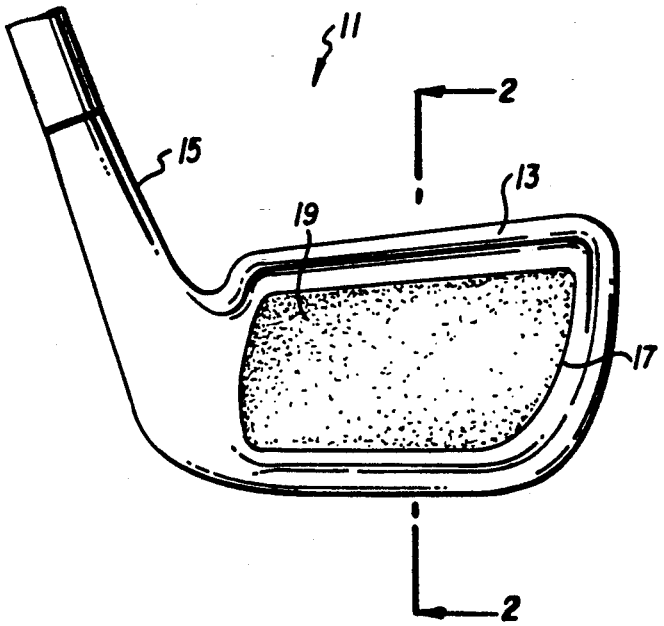
FIG. 1 is a rear view of a golf club iron incorporating the present invention.

Referring to FIG. 1, there is shown a partial view of golf club 11 which includes head 13 having a striking face 21 and hosel 15. Head 13 includes back cavity 17, which is substantially filled with a polyurethane 19.

Figure 2:
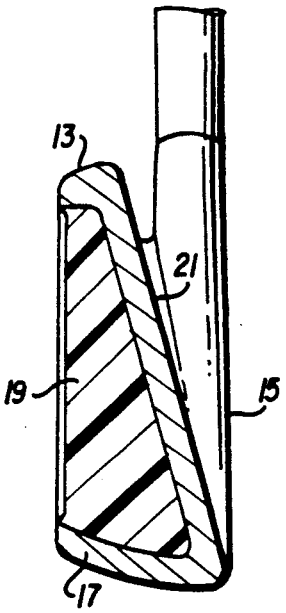
FIG. 2 is a partial sectional view taken through lines 2—2 of FIG. 2.

As shown in FIG. 2, polyurethane 19 substantially fills the entire rear cavity of the head.

The polyurethane is particularly advantageous in that it may be formed with the necessary characteristics of physical properties so as to provide the desired reduction in dampening of vibrations and still be tough enough to resist abrasions resulting from the heads of the irons striking each other in the golf bag.

The physical properties of the polyurethane used in the present invention include a hardness of 20–50 Shore D, preferably 30–40 Shore D, a flexural modulus of 1,000–50,000 p.s.i., preferably 10,000–30,000 p.s.i., a percent elongation of 100–600 and preferably 300–400, and a tensile strength of 2,000–8,000 p.s.i., preferably 4,000–6,000 p.s.i.

The polyurethane having the above-listed physical properties provides a softer, much more flexible material than can be provided by epoxy resins and gives a dramatic improvement in efficiency in dampening vibration. The highly mobile molecules (relative to the hard epoxy) of the present elastomeric materials are able to rotate and/or vibrate freely and dissipate or damp the vibrational energy caused by striking a ball.

At the same time, these materials are tough enough and have sufficient abrasion resistance to withstand any impact that the clubs may encounter or any potential damage in normal use, such as clubs hitting or rubbing each other in the golf bag, which can result in significant abuse.

The preferred polyurethane is the reaction product of an MDI isocyanate (4,4'-diphenylmethane diisocyanate) or MDI prepolymer, a polyether or polyester polyol, and a low molecular weight diol chain extender such as propanediol, butanediol, or the like.

Figure 3:
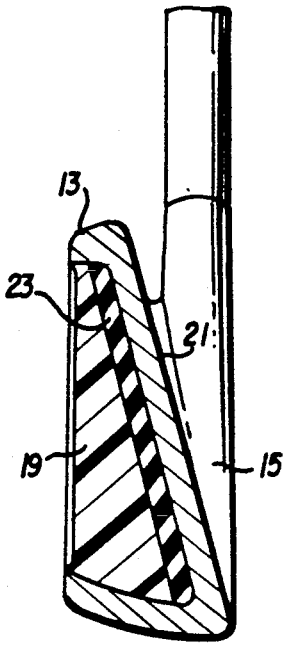
FIG. 3 is a sectional view similar to FIG. 2, but with a modification thereof.

Referring now to FIG. 3, there is shown a modification of the club illustrated in FIGS. 1 and 2. In the club head of FIG. 3, the rear cavity includes a highly shock-absorbent foam or gel (23) comprised of silicone rubber or a PVC plastisol or any synthetic or natural rubber. The foam or gel is placed against the rear cavity wall and then encased in the above-described urethane, thus even further improving the vibrational dampening action.

The above description and drawings are illustrative only and the present invention is to be limited only by the following claims.

We claim:

1. An iron-type golf club having a shaft and a head, said head comprising a striking face;

a cavity having an inner surface and defining a rear of said head opposite said striking face;

a polyurethane substantially filling said cavity;

said polyurethane having the following properties:

a hardness of substantially 20–50 Shore D;

a flexural modulus of substantially 1,000–50,000 p.s.i.;

a percent elongation of substantially 100–600; and a tensile strength of substantially 2,000–8,000 p.s.i.

2. The golf club of claim 1 wherein the hardness of said polyurethane is 30–40 Shore D, the flexural modulus is 10,000–30,000 p.s.i., the percent elongation is 300–400, and the tensile strength is 4,000–6,000.

3. The golf club of claim 1 wherein said polyurethane is the reaction product of an MDI isocyanate (4,4'-diphenylmethane diisocyanate) or MDI prepolymer, a polyether or polyester polyol, and a low molecular weight diol chain extender.

4. The golf club of claim 3 wherein said diol chain extender is propanediol.

5. The golf club of claim 3 wherein said diol chain extender is butanediol.

6. The golf club of claim 1 further comprising a shock-absorbing gel between the inner surface of said cavity and said polyurethane.

7. The golf club of claim 6 wherein said shock-absorbing gel is selected from a group comprising silicone rubber
PVC plastisol
synthetic rubber
natural rubber.

8. The golf club of claim 1 further comprising a shock-absorbing foam between the inner surface of said cavity and said polyurethane.

9. The golf club of claim 8 wherein said shock-absorbing foam is selected from a group comprising silicone rubber
PVC plastisol
synthetic rubber
natural rubber.

* * * * *